United States Patent [19]

Hamberg

[11] Patent Number: 4,837,859

[45] Date of Patent: Jun. 13, 1989

[54] SUPPLEMENTARY CLOTHING

[76] Inventor: Bjorn Hamberg, P.O. Box 94, S-822 00, Alfta, Sweden

[21] Appl. No.: 940,056

[22] Filed: Dec. 10, 1986

[51] Int. Cl.[4] ..... A41D 13/00

[52] U.S. Cl. ..... 2/2; 2/1; 2/24; 2/44; 2/46; 2/48

[58] Field of Search ..... 2/1, 2, 46, 48, 44, 2/24

[56] References Cited

U.S. PATENT DOCUMENTS

| | | | |
|---|---|---|---|
| 1,364,276 | 1/1921 | Hannaford | 2/48 X |
| 1,386,777 | 8/1921 | George | 2/48 X |
| 1,406,225 | 2/1922 | Rathsmill | 2/46 |
| 2,446,006 | 7/1948 | Hendricks | 2/2 |
| 2,794,186 | 6/1957 | Butters | 2/1 |
| 3,185,362 | 5/1965 | Wakefield | 2/24 X |
| 3,708,799 | 1/1973 | Smithdeal | 2/46 |
| 4,449,252 | 5/1984 | Sullinger | 2/46 |
| 4,459,703 | 7/1984 | Kosmas et al. | 2/48 |
| 4,474,573 | 10/1984 | Detty | 2/24 X |
| 4,689,829 | 9/1987 | Kaplan | 2/46 |
| 4,735,423 | 4/1988 | Foss | 2/46 X |

OTHER PUBLICATIONS

Abridgement of Swedish Design Patent Application. No. 85—2495—Yvonne Andersson; Published 1986-0-7-16.

Abridgement of Swedish Design Patent Application No. 86—0169—Roine Jonsson; Published 1986-08-27.

*Primary Examiner*—Werner H. Schroeder
*Assistant Examiner*—D. Biefeld
*Attorney, Agent, or Firm*—Ian Fincham; James Hellwege

[57] ABSTRACT

There is disclosed a supplementary clothing article suitable for outdoor use to provide an insulated area between a user and a substrate surface, such as a cold surface. The article is adapted to be worn about a user's torso in a folded condition when not in use, and to be unfolded for use. The article is made up of a plurality of pad members each comprised of a layer of insulating material, namely a mat of heat insulating material provided with an outer covering of a textile material a flexible connection forming a fold area between the adjacent pad members and a pair of spaced-apart flexible strap means, one of the strap means being near the upper end of the upper pad member for encircling a wearer's torso at the waist and the other strap means being near the upper end of the lower pad member for encircling a wearer's torso at the waist when the article is in a folded form, or when the article is in use, to encircle the lower torso in the region of a user's legs.

12 Claims, 2 Drawing Sheets

FIG. 5
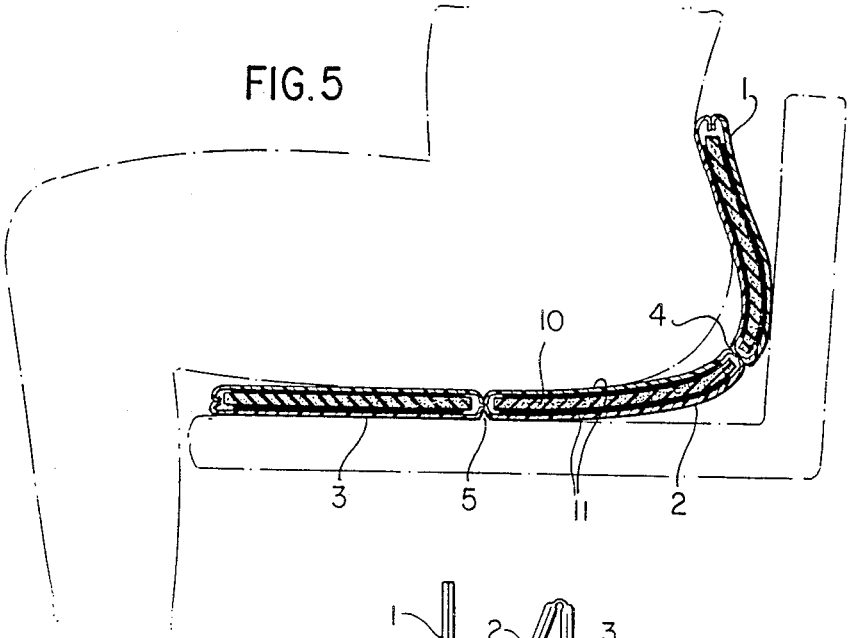
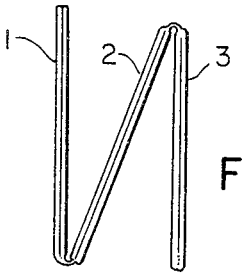
FIG. 6

SUPPLEMENTARY CLOTHING

This invention relates to an article of wearing apparel adapted to be worn as a supplementary clothing article for outdoor use in particular.

In many different outdoor activities, there is a need for an article of clothing which can be used to keep the lower portion of the body of a torso warm or free from contact with moisture or cold during various activities such as would occur during the use of ski-lifts, or hunting/fishing, etc. During such activities, a person sometimes sits down on cold or moist objects while at other times, a person must be free to move without restriction.

In the above activities, and others, and taking as an example a skier utilizing ski lifts, the skier will normally utilize a chair which despite the skiers clothing, is cold to sit on or depending on the weather conditions, such seating surfaces of the chairs may also be snow or ice coated, or even moist. Even with appropriate clothing, the area of contact of the body with a chair lift transmits cold through the skiers apparel and during such conditions, an uncomfortable situation for the skier can prevail.

In other circumstances, such as hunting or winter fishing, similar conditions can prevail where a hunter or fisher may rest while sitting on a surface which is cold and again, it can become quite uncomfortable for such a person to remain in such a condition for a very long period of time in addition, depending on the type of clothing worn by the person, cold and dampness may be transmitted through the wearer's clothing to the body.

The present invention is intended to provide an article of clothing which can be worn as a supplemental clothing article, which can be readily folded to a compact article to be carried about the users torso and can be readily unfolded for use when required to provide an insulating area between the user's body and a substrate surface when the user is desirous of, e.g., resting.

According to one form of the present invention there is provided an improvement in a supplementary clothing article wherein the article comprises first, second and third discrete members each having opposed lateral sides, the first, second and third members being joined together along hinge lines between the first and second members and between the second and third members, opposing end portions of the article being defined by an upper portion of the first discrete member and a lower portion of the third discrete member, the hinge lines forming a flexible connection between adjacent members whereby adjacent ones of the members may be placed in juxtaposition with each other to form a layered or folded article and, when unfolded about the hinge lines, to provide a lay-flat article, a pair of spaced-apart flexible attachment means, the attachment means comprising first strap means connected to an upper portion of the first member and extending laterally therefrom, and second strap means connected to an upper portion of the third member and extending laterally therefrom, the first strap means being adapted to encircle a user's torso at the waist thereof, the second strap means being adapted either to encircle a user's torso at the waist thereof when the article is in its folded form or to encircle the user's lower torso in the region of the user's legs when the article is in its unfolded form.

More particularly, in accordance with the present invention, there is provided a supplementary clothing article adapted to be carried in a folded condition about a user's torso and for use, to be unfolded to provide an insulated area between a substrate and the users body, comprising a one-piece supplementary clothing article adapted to be carried in a folded condition about a user's torso and for use, to be unfolded to provide an insulated area between a substrate and the user's body, comprising: (a) a one-piece member of heat insulating material having continuous upper and lower ends; the member comprising at least one upper pad member having a free edge forming the continuous upper end, at least one intermediate pad member, and at least one lower pad member with the lower pad member forming the continuous lower end, the pad members each being comprised of a mat of heat insulating material provided with an outer covering of a textile material, (b) a flexible connection forming a fold area between the intermediate pad member and each of the adjacent upper and lower pad members to permit adjacent ones of the pad members to be placed in juxtaposition with each other to form a layered or folded article and when unfolded about the fold area, to provide a lay-flat article; and (c) a pair of flexible strap means, spaced-apart along the length of the article, such strap means comprising a first set of belts connected to the upper portion of the upper pad member and a second set of belts connected to the upper portion of the lower pad member, the first set of belts being adapted to encircle a user's torso at the waist thereof and engage each other, the second set of belts being adapted to engage each other either to encircle a user's torso at the waist thereof when the article is in its folded form, or to encircle the user's lower torso in the region of the user's legs when the article is in its unfolded form and at the same time, to permit the article to be unfolded about the fold areas into a lay-flat form; again in such a preferred embodiment, the pair of pad members remote from each other are provided with belt means, one of which is adapted to be releasably applied around the torso at the waist thereof, and one another of which is connected to the upper portion of the lower pad so that it can selectively be applied around the torso at the waist thereof when the pad members are in a folded condition, or applied to the lower torso in the region of the user's legs when the article is in use in an unfolded condition.

In the article of the present invention, the pad members are preferrably dimensioned and sized so as to provide a total length for the supplementary clothing article to extend from e.g. the lower part of the back of the body to a point extending, for example, to the knees of the average adult human torso although variations in this length can be obviously made, depending on whether the supplementary clothing article is specifically adapted for, e.g., a skier or on the other hand, e.g. a hunter. Thus, in some cases, it may be advantageous to provide a somewhat longer length for the article where it may be desired to protect more of a skier's leg area than, for example, a similar garment used for hunting. Additionally, the length of the garment may also be varied depending on whether it is made for children, young adults or adults.

The supplementary clothing article of the present invention is primarily adapted to protect the backside of the user and thus, the width of the garment will be appropriate to achieve this purpose; the garment is preferrably constructed so as to have a width sufficient to protect the rear or backside portions of the human torso and commenturately, a width sufficient to embrace the width of a user's legs to protect the same against any cold or like substrate. To this end, the garment of the device can be contoured, as described and shown in greater detail hereandafter, to provide a garment which readily folds into a compact condition and which when worn, in a folded condition, provides a non-obstructing article which can be readily carried about a user's torso when not in use.

The pad members of the article of the present invention are comprised of insulating material, which can be any suitable material for the purpose intended. Typically, heat insulating materials for this purpose can be employed, which may, e.g., be of thin flexible polyurethane foam or the like, provided with an outer covering of suitable material such as textile material. Such textile material can enclose or encompass the insulating material; alternately, insulating materials having bonded layers of textile fabric or the like can be employed.

The flexible connections between adjacent pad members, and which form fold areas, to permit the folding and unfolding of the pad members, are formed of thin flexible ligaments, preferrably continuous, between adjacent pad members; to this end, the fold areas may consist of one or more layers of the outer textile material used for covering the insulating material, or the like equivalent arrangements, which extend between adjacent pad members.

Normally, a plurality of such pad members are employed in the supplementary clothing article of the present invention; in a preferred embodiment, the article comprises three pad members for ease of folding and unfolding and for carrying about a wearer's torso. Such members are appropriately dimensioned, both length and widthwise, to be borne about a user's torso.

The strap means serve as a dual function - that of permitting the article to be carried about a user's torso in a compact, folded condition and in a secure manner; and at the same time, to permit the article to be readily unfolded and subsequently retained in place in an unfolded condition when it is desired to use the article. To this end, a particularly preferred form having advantageous features is to utilize a pair of spaced belt means connected to the article in such a manner that in a folded condition, at least one, and preferrably both of the belt means can be secured about the user's torso for carrying the article with the pad members in a folded condition located at the back of the user with the belt means extending around the body while conversely, in an unfolded condition, the belt means can be used to secure the article about the user's torso in the midsection thereof for one of the belt means, and about the legs of the user for the other spaced apart belt means.

For ease of manufacture and use, such belt means may each be a pair of straps appropriately dimensioned so that one set of the pair of belt means forms a cooperating set to be secured about the mid portion of the user's torso and the other of the pair of belt means comprises a set of straps again dimensions to be joined together about the user's legs. Typically, such belt means may be provided with suitable fastening elements such as "velcro" fasteners, snap means or the like.

The article of the present invention is simple to manufacture and possesses the advantage that it is compact for portability and can be readily worn by a user without restricting movement. In a like manner, it can be readily unfolded and placed into use very simply and quickly.

Devices of the present invention can be employed for military training, driving vehicles, fishing (such as winter fishing), hunting, using ski lifts, during skiing, mountain climbing and walking, etc. - in general, in situations where individuals at time must be capable of moving freely and at other times, where such activities require sitting on cold or moist objects.

Having thus generally described the invention, reference will now be made to the accompanying drawings, illustrating preferred embodiments and in which;

FIG. 5 is a fragmentary cross-section taken through adjacent pad members showing the form-sustaining interior structure having layers of textile fabric bonded thereto; and FIG. 6 is a fragmentary cross-section similar to FIG. 5 showing the article in partially folded condition.

Figure 1:
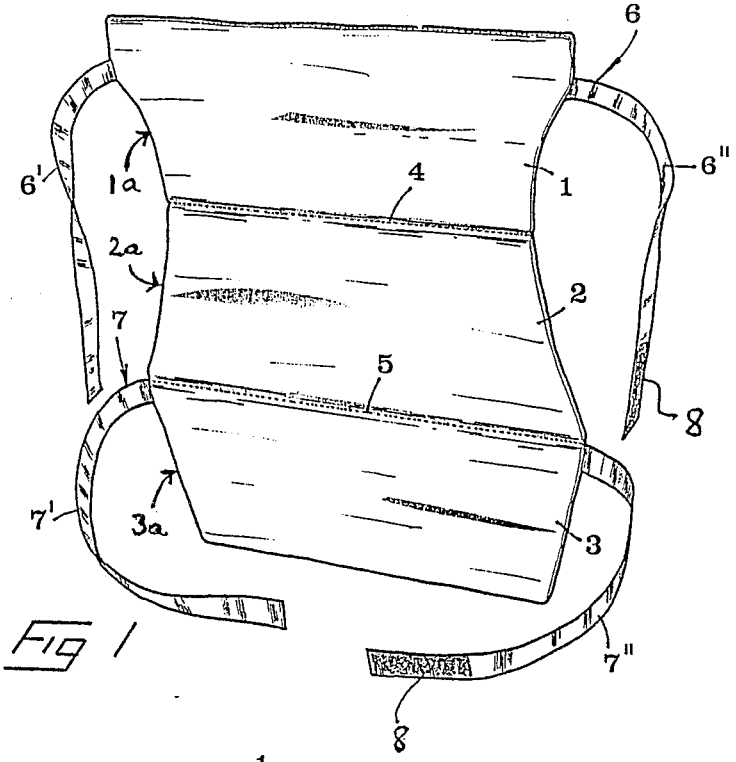
FIG. 1 is a perspective view of an article of the present invention illustrating the seat-pad in an unfolded condition.

Referring now to the drawings, the article of the present invention is illustrated as comprising three separate pad members designated by reference numerals 1, 2 and 3, joined together along a fold area indicated by reference numerals 4 and 5. Each pad members may consist of heat insulating flexible material of a relatively thin thickness, incororated between, e.g., a pair of layers of textile lining material which may then be sewn along the borders thereof to enclose the respective heat insulating material of each pad member.

The fold areas between adjacent pad members can be readily and simply formed by utilizing one or both layers of the flexible textile material and, for example, sewing seams between adjacent pad members to form the fold areas 4 and 5.

A preferred and advantageous form of the article is illustrated in the drawings where the spaced apart flexible strap means comprises a first belt indicated generally by reference in numeral 6 made of a pair of straps six prime and six double prime, which may be attached to the textile material surrounding the pad member as, for example, by sewing although other equivalent means can be employed for this purpose. In a like manner, the lower pad member 3, remote from the upper pad member 1, includes a second belt indicated generally by reference numeral 7 and which is likewise formed of a pair of individual straps seven prime and seven double prime again which may be attached to the textile material by sewing or the like.

Figure 2:
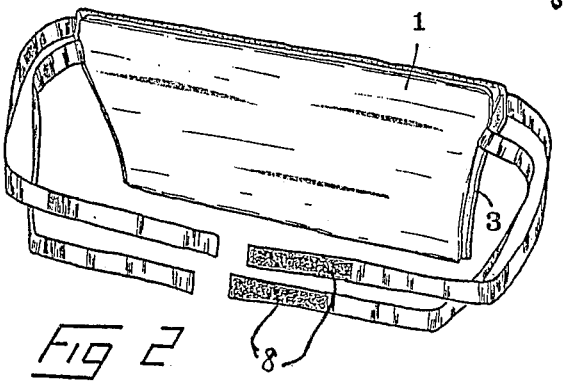
FIG. 2 is a perspective view of the article of FIG. 1 showing the same in a folded condition.
Figure 3:
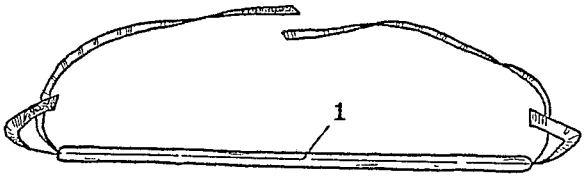
FIG. 3 is a top planned view of the article of FIG. 1.
Figure 4:
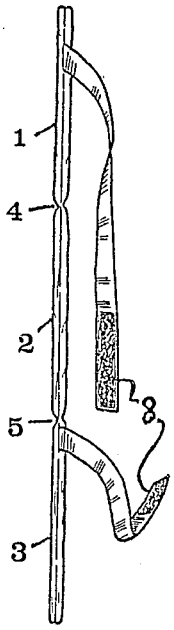
FIG. 4 is a sdie view of the article of FIG. 1.

In the arrangements illustrated, each of the pad members may be contoured in the form shown in FIG. 1 so as to have a pair of opposed sides indicated generally by reference numeral 1a, 2a and 3a; where the sides of members 1 and 2 inwardly taper towards each other so as to form together a semi-circular arcuate configuration, in this manner, upon folding up, the article has the shape illustrated in FIG. 2 which when worn about the body of a user, with a pad member being at the back, does not interfer or otherwise hinder a user during e.g. walking.

As illustrated in greater detail in FIG. 5, the pad members of flexible material may have a formsustaining shape, such as being constructed as polyurethane foam 10, and which may have the outer layers of textile fabric 11 bonded to the foam. As shown in FIG. 6, the article will be folded by pulling on the straps 7′ and 7″ (FIG. 1) so that the intermediate pad 2 is lifted upwardly and inwardly towards pad 1 while pad 3 folds into juxtaposition with pad 2.

When the article is opened or folded down as shown in FIG. 1, the upper belt 6 of the upper pad 1 is applied around the mid-section of the user while the other two pad members 2 and 3 are permitted to hang down from the upper one. The second belt 7 is applied around the upper parts of the legs of the user and in such a condition, the seat-pad protects not only the lower part of the user's torso but also the seat and the upper parts of the legs (depending on the length of the same) thus keeping these parts warm or protected from substrates even if the user sits down on a cold surface. When the user stands up, and wants to be free to move about the two lower pad members 2 and 3 are folded up to the condition illustrated in FIG. 2. To enable the user to do so, the lower belt 7 may be first released, whereupon the two lower pad members can be folded along the fold lines 4 and 5 while still keeping the first belt 6 in place around the torso. Also, the second belt 7 can be applied around the mid-section of the torso if desired, thereby keeping the two pad members 2 and 3 in the folded condition illustrated in FIG. 2.

The belt members can be tied together or as illustrated, may include end portions having adhereing means such as "velcro". Thus, the ends of the straps may be provided with such adhereing means such as indicated by reference numeral 8.

It will be understood that various modifications can be made to the above described embodiments, without departing from the spirit and scope of the invention as defined herein.

I claim:

1. A supplementary clothing article adapted to be carried in a folded condition about a user's torso and for use, to be unfolded to provide an insulated area between a substrate and the user's body, comprising: (a) a one-piece member of heat insulating material having continuous upper and lower ends; said member comprising at least one upper pad member having a free edge forming said continuous upper end, at least one intermediate pad member, and at least one lower pad member, with the lower pad member forming said continuous lower end, said pad members each being comprised of a discrete mat of heat insulating material provided with an outer covering of a textile material the pad members being substantially the same length ; (b) a flexible connection forming a fold area between said intermediate pad member and each of the adjacent upper and lower pad members to permit adjacent ones of said pad members to be placed in juxtaposition with each other to form a layered or folded article and, when unfolded about said fold area, to provide a lay-flat article; and (c) a pair of flexible strap means spaced-apart along the length of said article, said strap means comprising a first set of belts connected to the upper portion of said upper pad member, and a second set of belts connected to the upper portion of said lower pad member, said first set of belts being adapted to encircle a user's torso at the waist thereof and to engage each other, said second set of belts being adapted to engage each other either to encircle a user's torso at the waist thereof there when said article is in its folded form or to encircle the user's lower torso in the region of the user's legs when said article is in its unfolded form.

2. The supplementary clothing article of claim 1 wherein said mat is formed of thin, flexible, formsustaining polyurethane foam.

3. The supplementary clothing article of claim 1 wherein said mat is formed of a thin, flexible, form-sustaining polyurethane foam having layers of textile fabric bonded thereto.

4. The supplementary clothing article of claim 1 wherein said flexible connection comprise lines of stitching through said textile material.

5. In a supplementary clothing article adapted to be carried in a folded condition about a user's torso and to be unfolded for use, the improvement wherein:

said article comprises first, second and third discrete members each having opposed lateral sides, said first, second and third members being joined together along hinge lines between said first and second members and between said second and third members, opposing end portions of said article being defined by an upper portion of said first discrete member and a lower portion of said third discrete member, said hinge lines forming a flexible connection between adjacent members whereby adjacent ones of said members may be placed in juxtaposition with each other to form a layered or folded article and, when unfolded about said hinge lines, to provide a lay-flat article, a pair of spaced-apart flexible attachment means said attachment means comprising first strap means connected to an upper portion of said first member and extending laterally therefrom, and second strap means connected to an upper portion of said third member and extending laterally therefrom, said first strap means being adapted to encircle a user's torso at the waist thereof, said second strap means being adapted either to encircle a user's torso at the waist thereof when said article is in its folded form or to encircle the user's lower torso in the region of the user's legs when said article is in its unfolded form.

6. The supplementary clothing article according to claim 5 wherein said first strap means comprises a pair of strap means extending from said opposed lateral sides of said first member and adapted to engage each other.

7. The supplementary clothing article according to claim 5 wherein said second strap means comprises a pair of strap means extending from opposed lateral sides of said third member and adapted to engage each other.

8. The supplementary clothing article according to claim 5 wherein said first, second and third members comprise a heatinsulating material.

9. The supplementary clothing article according to claim 5 wherein the opposed lateral sides of said first and second members taper inwardly towards the hinge line joining same so as to form together a semi-circular arcuate configuration.

10. The supplementary clothing article of claim 8, wherein said members are formed of thin, flexible, form-sustaining polyurethane foam.

11. The supplementary clothing article of claim 5, wherein said members are formed of a thin, flexible, form-sustaining polyurethane foam having layers of textile fabric bonded thereto.

12. The supplementary clothing article of claim 5, wherein said hinge lines include lines of stitching between said discrete members.

* * * * *